United States Patent [19]

Brobeil

[11] 4,319,640

[45] Mar. 16, 1982

[54] GAS GENERATOR-ACTUATED FIRE SUPPRESSANT MECHANISM

[75] Inventor: Karl R. Brobeil, Warren, Mich.

[73] Assignee: The United States of America as represented by the Secretary of the Army, Washington, D.C.

[21] Appl. No.: 101,327

[22] Filed: Dec. 6, 1979

[51] Int. Cl.[3] ..... A62C 35/02

[52] U.S. Cl. ..... 169/28; 169/9; 220/372

[58] Field of Search ..... 169/28, 62, 9, 84, 85, 169/56, 62, 61; 220/23 R, 319, 372, 373; 222/3; 280/728, 729, 731

[56] References Cited

U.S. PATENT DOCUMENTS

| | | | |
|---|---|---|---|
| 1,031,867 | 7/1912 | Peebles | 220/23 |
| 2,577,744 | 12/1951 | Faust | 169/9 |
| 2,603,308 | 7/1952 | McCall | 220/372 |
| 2,713,391 | 7/1955 | Buckholtz | 169/28 |
| 2,719,589 | 10/1955 | Mapes | 169/28 |
| 2,808,114 | 10/1957 | Parker, Jr. et al. | 169/28 |
| 3,199,600 | 8/1965 | Jacobs | 169/9 |
| 3,915,237 | 10/1975 | Rozniecki | 169/28 |
| 4,136,796 | 1/1979 | Dubois et al. | 220/373 |

FOREIGN PATENT DOCUMENTS

| | | | |
|---|---|---|---|
| 274843 | 11/1927 | United Kingdom | 169/28 |

*Primary Examiner*—H. Grant Skaggs
*Assistant Examiner*—Kenneth Noland
*Attorney, Agent, or Firm*—Peter A. Taucher; John E. McRae; Nathan Edelberg

[57] ABSTRACT

A fire-suppressant mechanism especially designed for suppressing near-explosive fires or slow growth fires in military vehicles. The mechanism includes a thick-walled bottle or container partially or wholly filled with liquid fire-suppressant, such as Halon 1301. A chemical gas-generating cartridge is located at one end of the container for substantially instantaneously generating a very high gaseous pressure within the container, thereby very rapidly expelling the liquid suppressant from the container onto an emergent fireball.

1 Claim, 5 Drawing Figures

GAS GENERATOR-ACTUATED FIRE SUPPRESSANT MECHANISM

The invention described herein may be manufactured, used and licensed by or for the Government for governmental purposes without payment to me of any royalty thereon.

BACKGROUND AND SUMMARY OF THE INVENTION

Military vehicles, such as tanks and armored personnel carriers, carry large quantities of fuel. Should the fuel tank or tanks be penetrated by an enemy projectile, such as an armor-piercing shaped charge warhead, the contained fuel is likely to be instantaneously ignited in near-explosive fashion. There are in existence fire-suppresant mechanisms for such near-explosive fires. One such mechanism includes a thick-walled bottle partially filled with a liquid fire-suppressant such as Halon 1301 (bromotrifluoromethane). The liquid is pressurized to approximately 750 p.s.i.g. by direct contact with a dry pressurized gas such as nitrogen.

Certain problems exist in connection with such prepressurized bottle systems, as outlined for example in U.S. Pat. No. 3,915,237 issued to E. J. Rozniecki. One problem concerns slow prolonged dissolving of nitrogen into the Halon 1301, causing loss of pressurization subsequent to the initial bottle-charging operation. Another problem concerns the requirement for very accurate measurement of the nitrogen and Halon in order to achieve a desired pressure range. On a weight basis approximately 0.04 pounds of nitrogen are required for each pound of Halon 1301 in order to achieve a pressure of 750 p.s.i.g. at 70° F. If the charging operation is carried out on a weight basis a very accurate weighing scale is required. If the operation is carried out on a pressure basis then corrections must be made for temperature effects; also, during the charging operation the bottle must be continually agitated to cause nitrogen to go into solution with the Halon at a satisfactory rate. Charging the bottle in the field (at a military depot) becomes a time-consuming laboratory type operation.

The existing system suffers in an operational sense in that the bottle pressure is limited by nitrogen solubility considerations, and the detracting effect of nitrogen bubbles on the flow rate of Halon out of the bottle. Also, the fact that the bottle is at a high internal pressure aggravates leakage problems and necessitates routine periodic surveillance of the bottle; otherwise the bottle will have insufficient Halon agent and pressure when it is necessary to suppress a fire.

The present invention relates to a fire-suppressant mechanism that includes a pressure-resistant bottle filled with liquid Halon 1301 at normal vapor pressure. At one of the bottle ends there is mounted a gas-generating cartridge that may be constructed as shown and described in U.S. Pat. No. 3,877,882 to Lette et al and 3,895,098 to J. F. Pietz. The cartridge includes a confined mixture of reactant particulates that are ignitable to exothermically react together and substantaneously instantaneously produce large quantities of nitrogen gas. The generated gas is confined to the space within the bottle, thereby producing an internal step pressure increase in excess of fifty atmospheres pressure, sufficient to rapidly expel the Halon 1301 through a discharge duct onto an emergent fireball. The entire sequence of events, from initial signal to the extinguisher through liquid Halon 1301 out condition, preferably takes less than 30 milliseconds.

The mechanism of this invention is advantageous in that the bottle is at Halon 1301 vapor pressure until the instant when a fire-suppressant action is required; bottle leakage problems are thereby reduced. Also, the Halon discharge rate can be somewhat greater than with the prior art system, because the expelling pressure is not limited by nitrogen-solubility factors; since the nitrogen is generated so quickly it does not have an opportunity to dissolve in the Halon or to form flow-detracting bubbles. Use of a gas-generating cartridge, as herein proposed, is also advantageous in that laborious bottle-charging operations are largely avoided. The cartridge is easily and quickly mounted on the bottle without necessity for weighing, measuring, or determining the nitrogen contents pressure or weight. Field charging operations are greatly simplified.

THE DRAWINGS

Figure 1:
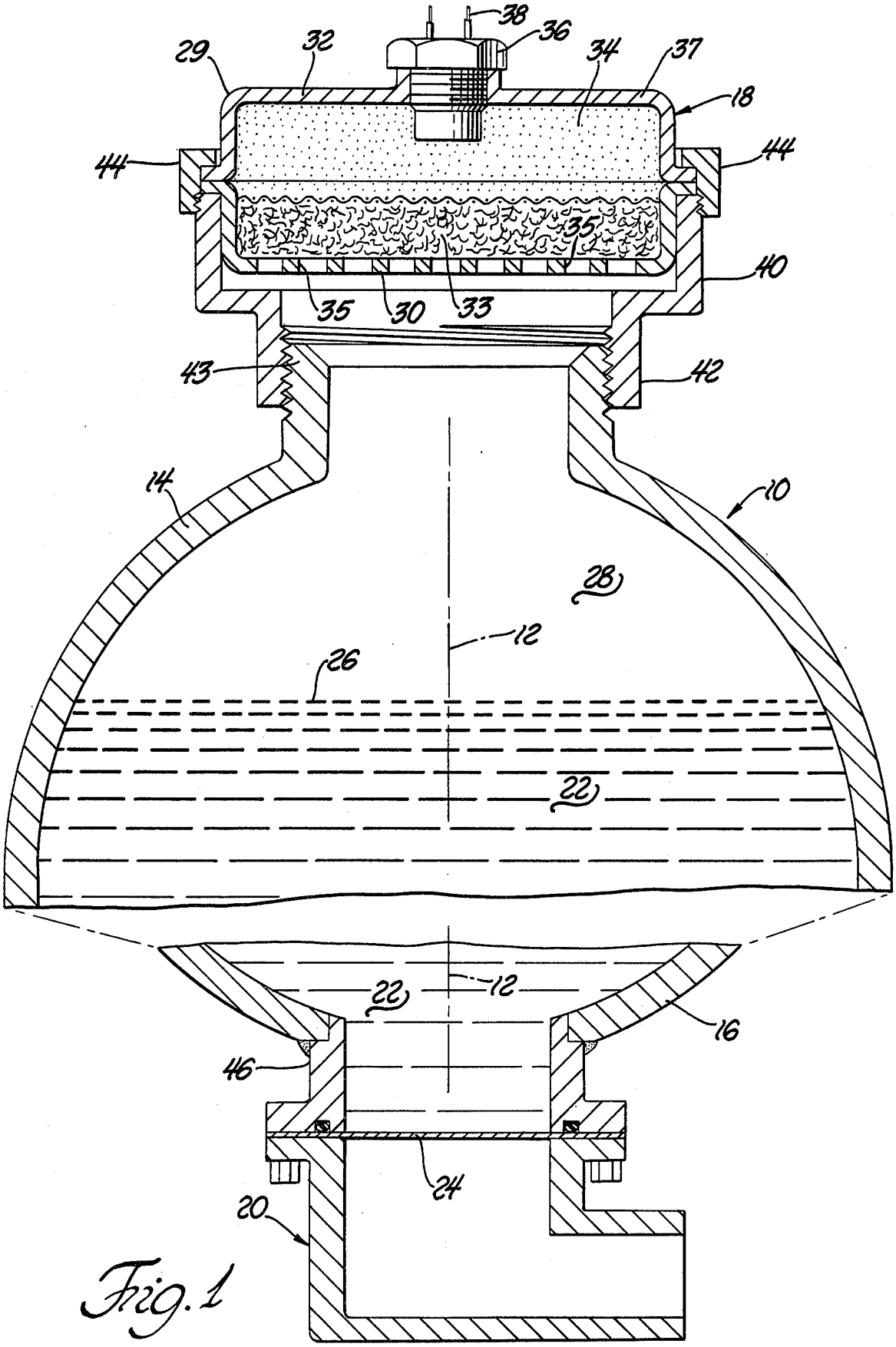
FIG. 1 is a sectional view showing the upper and lower ends of a fire-suppressant bottle embodying my invention.

Referring in greater detail to FIG. 1, there is shown a fire suppressant mechanism comprising a conventional thick-walled cylindrical container or bottle 10 positionable in an upright attitude with its longitudinal axis 12 in a vertical orientation. The bottle is provided with a spherical upper end 14 and a spherical lower end 16. The bottle upper end mounts a gas-generating device 18, and the bottle lower end mounts a discharge duct 20 for liquid fire-suppressant 22 contained within the bottle. Piping, not shown, may be connected with duct 20 for directing the liquid to an emergent fireball remote from bottle 10. A rupturable diaphragm type valve element 24 is located within duct 20 to prevent liquid discharge except when gas-generator device 18 is electrically triggered to develop a very high gaseous pressure on the upper surface 26 of the liquid. A high pressure in space 28 (above the liquid) causes the liquid to rupture the diaphragm-type valve element 24 and flow through duct 20 toward an emergent fireball, not shown. The entire sequence, from initial triggering of the gas-generator to expelling of liquid Halon preferably takes less than 50 milliseconds, i.e. before the fireball has had an opportunity to propogate into such massive proportions as would seriously burn or suffocate personnel within the vehicle. U.S. Pat. No. 3,825,754 to Cinzori and U.S. Pat. No. 4,110,812 to Artunian et al show features of a fire detection system and electrical trigger system usable with the FIG. 1 fire suppressant bottle to achieve a satisfactory fire-out time.

I envision that gas-generating device 18 will be similar to already-devised devices commercially available from Talley Industries, Inc. Such commercially available devices are believed to be constructed generally as shown in previously mentioned U.S. Pat. Nos. 3,877,882 and 3,895,098. As depicted in attached FIG. 1, the gas-generating device comprises a cylindrical container 29 defined by two cup-shaped metal elements 30 and 32 secured and sealed together at their mating edges. Confined within the upper portion of the container is a mass of reactant particles 34, e.g. a mixture of 62 weight % sodium azide and 38% copper oxide. The reactants are ground and blended as described in U.S. Pat. No. 3,895,098. Ignition of the reactants generates large quantities of nitrogen gas.

Electrical ignition of the reactant mass 34 is accomplished by a conventional squib 36 mounted in the container upper wall 37. A heating element within the squib receives a step voltage increase through lead wires 38, thereby igniting an explosive charge within the squib. The resultant high temperature condition triggers an exothermic reaction in mass 34, which generates large quantities of nitrogen gas, together with some solid reaction products in particulate form. The reaction requires only a few milliseconds from electrical step voltage change to gas generation.

The lower portion of container 29 is occupied by a suitable gas-particle filtering agent 33, which may comprise a series of fine mesh screens and/or metal wool, as described in U.S. Pat. No. 3,877,882. The lower wall of container 29 may be provided with a number of flow openings or ports 35 for enabling the generated nitrogen gas to flow downwardly into space 28, thereby highly pressurizing the liquid 22.

Gas generating device 18 is removably seated in a hollow tubular holder 40 that is suitably mounted on neck area 43 of bottle 10. A collar 44 screws onto holder 40 to retain gas generator 18 in a fixed position. The collar can be unscrewed from holder 40 when it becomes necessary to replace the gas generator.

The FIG. 1 system is advantageous in that the bottle need not be pressurized to a high internal pressure during the standby periods. Thus, there is no requirement for accurately adding precise quantities of nitrogen or other pressurized gas during the bottle-filling operation. Consequently, there is no need to worry about nitrogen solubility in the Halon 1301 or the effects of temperature and bottle agitation on bottle performance. Since the bottle is at atmospheric pressure during the standby periods there is no problem concerning slow leakage out of the bottle. The seal around diaphragm 24 is substantially unloaded during the standby periods, with consequent advantages as regards assurance that the bottle will be operational at the moment of an emergency. Also, there is a lessened danger that the bottle might be accidentally tripped or discharged by a soldier during non-emergency periods.

When squib 36 is actuated the reactant particles 34 undergo an exothermic reaction, which instantaneously produces large quantities of nitrogen gas in space 28 above liquid 22. The high gaseous pressure causes liquid 26 to rupture diaphragm 24 and flow outwardly through duct 20 toward the emergent fireball. Driving pressure on the liquid is believed dependent at least partly on the quantity of reactant particles 34. With the chemical gas generator shown in attached FIG. 1, it is believed possible to achieve substantially higher driving pressures than are possible in the prior art system. A usable pressure with the prior art system is approximately forty to fifty atmospheres; gas generator 18 is believed capable of generating pressures on the order of one hundred or more atmospheres, with a correspondingly higher liquid flow rate through duct 20. The gas generator reactant mass 34 need only be a few ounces to achieve the desire pressure.

It is believed that with the above description the general features of my invention will be apparent. However, attached FIGS. 2 through 5 illustrate other forms that the invention can take. Similar reference numerals are employed for similarly functioning components.

Figure 2:
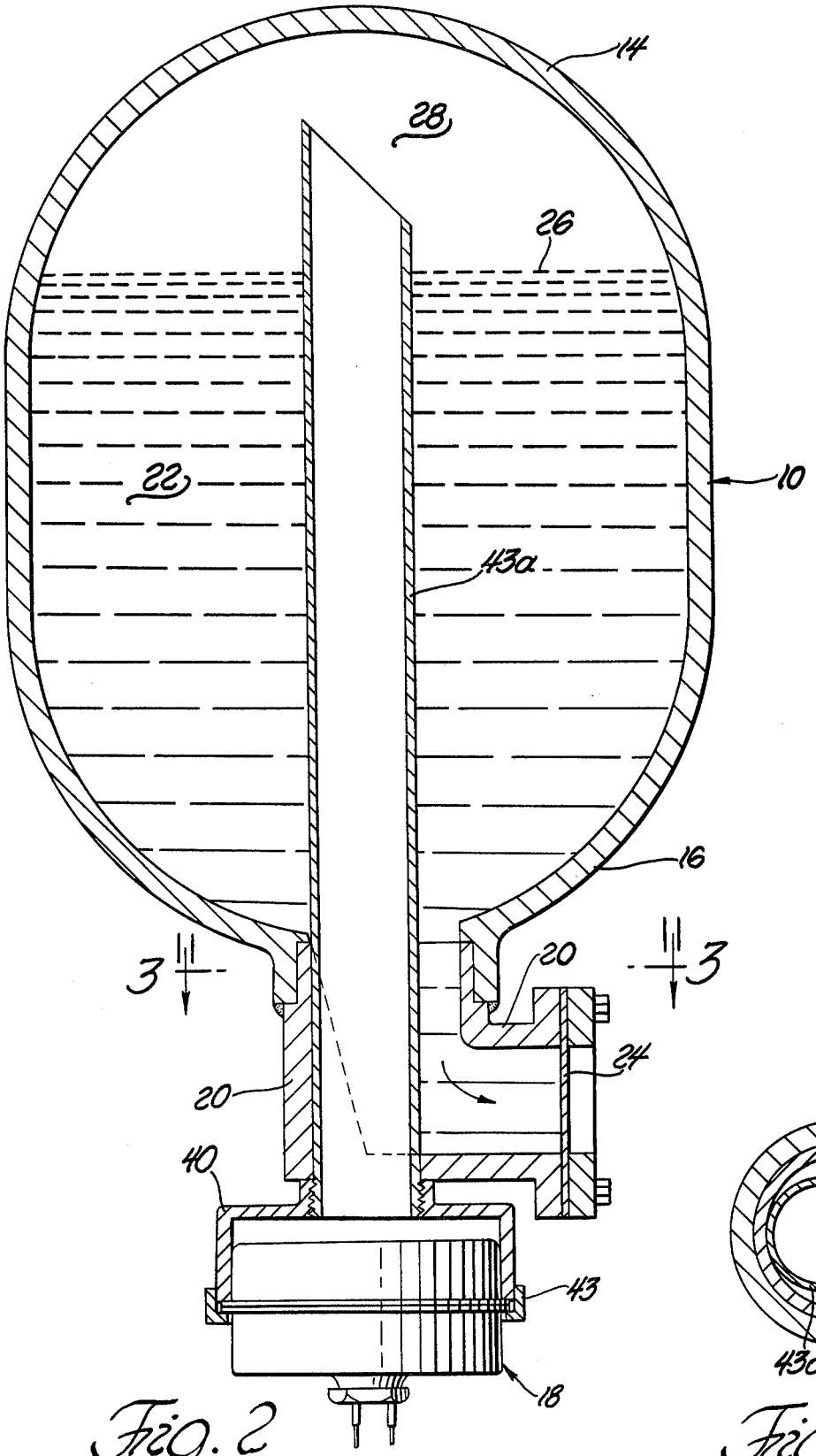
FIG. 2 is a sectional view taken through a second embodiment of my invention.
Figure 3:
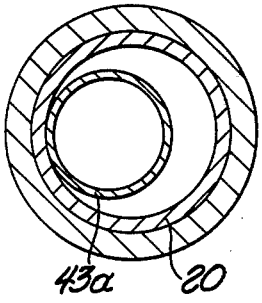
FIG. 3 is a fragmentary sectional view on line 3—3 in FIG. 2.

In FIG. 2, both the discharge duct 20 and the gas generating device 18 are located at the lower end of container 10. In this case the gaseous pressure generated by device 18 is applied to liquid 22 through an elongated pressure-delivery tube **43*a* that extends upwardly through the liquid to a point above liquid surface 26. Operation of the FIG. 2 system is similar to that of FIG. 1**.

Figure 4:
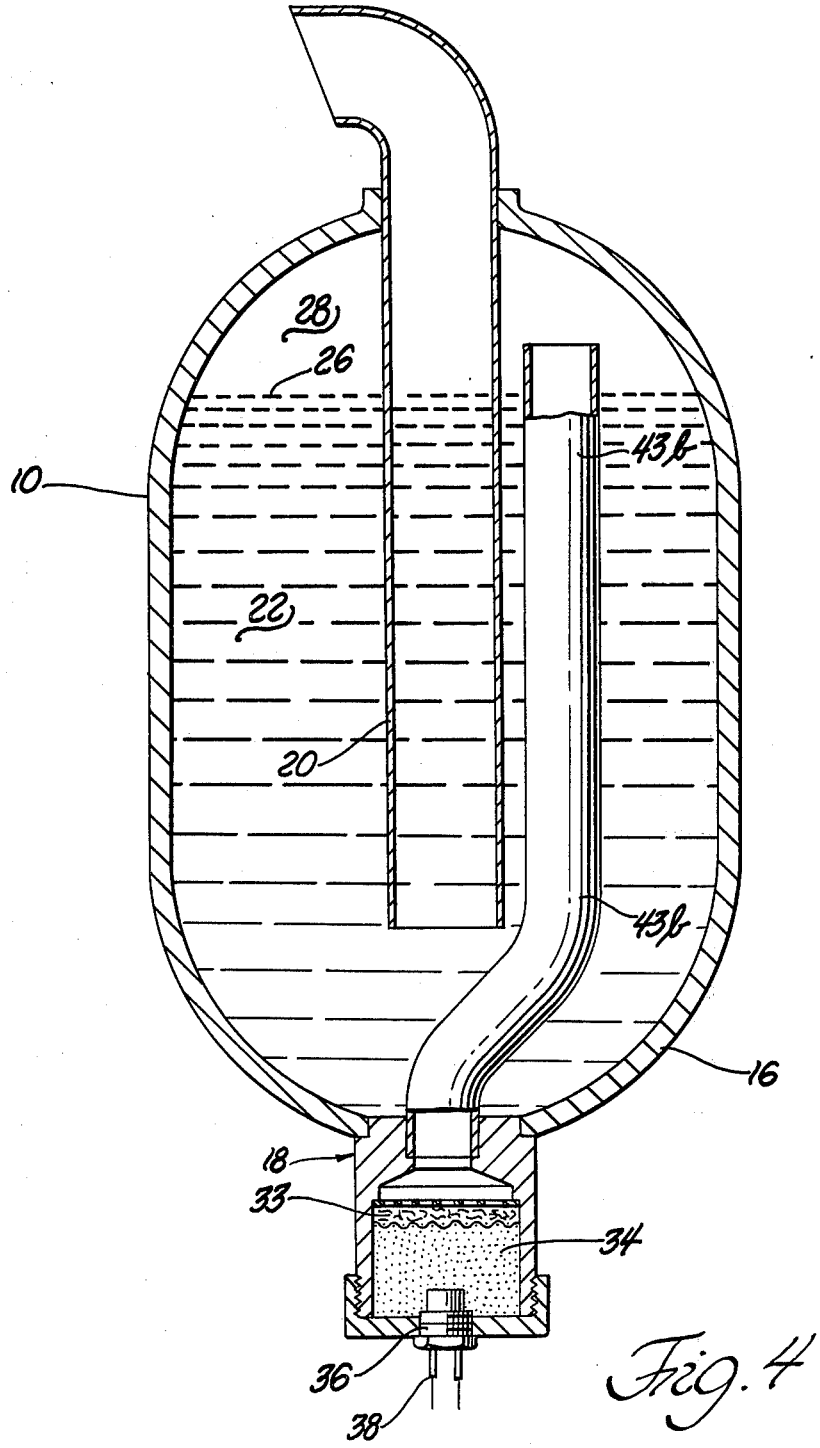
FIG. 4 is a sectional view taken through a third embodiment of my invention.

In FIG. 4 the gas generating device 18 is located at the lower end of container 10; the liquid discharge duct 20 is an elongated duct that extends from a point near the lower end of container 10 upwardly through liquid 22 and out the upper end of the container. In this embodiment it is not necessary to use a valve similar to valve 24. Gas-generating device 18 is affixed directly to the lower end of container 10 rather than being supported in a holder similar to holder 40. Gas pressure is applied to the liquid through an elongated pressure delivery tube **43*b* that extends upwardly through the liquid into continual communication with space 28**.

Figure 5:
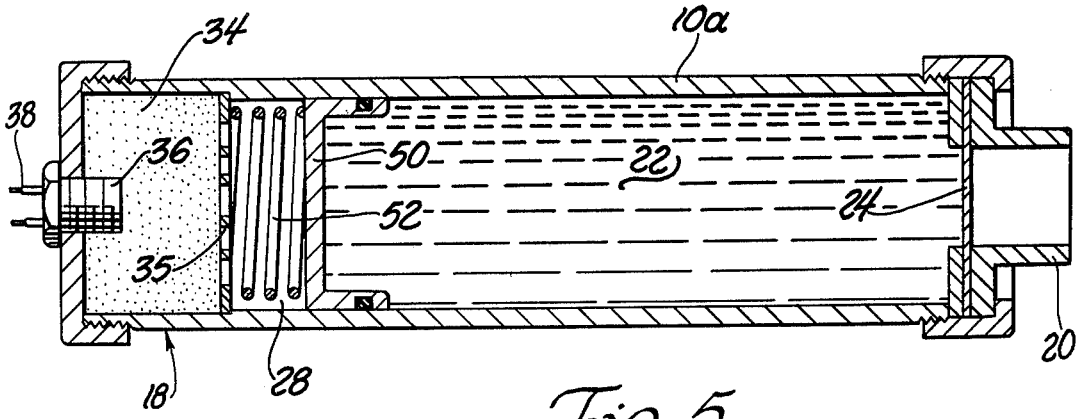
FIG. 5 is a sectional view taken through a fourth embodiment of my invention.

FIG. 5 illustrates a fire-suppressant mechanism designed for disposition in a prone position; it is useful where space in the vertical direction is limited, as in the situation discussed in already-filed U.S. patent application Ser. No. 14,502, filed in the name of A. J. Monte on Feb. 23, 1979. In the FIG. 5 mechanism the gaseous pressure developed by generator 18 is applied against the left face of a floating piston 50 that physically separates liquid 22 from the gas generator; a light compression spring 52 urges the piston rightwardly to prevent air pockets within liquid 22 during standby periods. When reactant mass 34 is ignited a very high gaseous pressure is developed in space 28, thereby moving piston 50 to the right for expelling liquid 22 through duct 20. Piston 50 could be replaced by a bellowfram or other type movable partition. However the piston is probably an economical mechanism for achieving a long stroke, hence large liquid delivery. Sealing problems are not difficult because the liquid is essentially at atmospheric pressure until the instant when generator 18 is actuated.

I wish it to be understood that I do not desire to be limited to the exact details of construction shown and described for obvious modifications will occur to a person skilled in the art.

I claim:

1. A fire-suppressant mechanism for disposition in a military vehicle to suppress near-explosive fires, comprising a container at least partially filled with vaporizable fire-suppressant liquid at normal liquid vapor pressure, said container including a cylindrical upright bottle having a vertical longitudinal axis; an L-shaped liquid discharge duct (20) connected to the lower end of the bottle for directing fire-suppressant liquid from the bottle laterally toward an emergent fireball; a frangible diaphragm interposed between the bottle lower end and discharge duct to normally prevent passage of liquid through the duct; said bottle having a neck (43) at its upper end defining a passage; a hollow tubular cup-shaped holder (40) having a depending annular section (42) screwed onto said neck in an area above the bottle; a gas-generating device bodily installable within the holder for generating at least fifty atmospheres gaseous pressure in the aforementioned passage and space above the fire-suppressant liquid, sufficient to rapidly expel the liquid through the aformentioned discharge duct; said gas-generating device comprising a cylindrical container (29) containing a mass of reactant particulates ignitable to produce a gaseous pressure by exothermic reaction, an electrical igniter (36) carried on the upper end wall of the cylindrical container for igniting the particulates, and openings in the lower end wall of the container for conducting gaseous pressure from the container downwardly into the neck area of the bottle; said container having means thereon for spacing its lower end wall from the opposed internal surface of the tubular holder whereby all of the openings in said lower end wall communicate with the above-mentioned passage defined by the neck area of the bottle; and an annular collar screwable onto an external surface of the tubular holder to exert a clamping force on the gas-generating device container; said collar being unscrewable from the holder to permit bodily removal of the gas-generating device from the holder.

* * * * *